US010246778B2

(12) United States Patent
Janik et al.

(10) Patent No.: US 10,246,778 B2
(45) Date of Patent: Apr. 2, 2019

(54) ELECTROLESS NICKEL PLATING SOLUTION AND METHOD

(71) Applicant: MacDermid Acumen, Inc., Waterbury, CT (US)

(72) Inventors: Robert Janik, Pinckney, MI (US); Nicole J. Micyus, South Lyon, MI (US)

(73) Assignee: MacDermid Acumen, Inc., Waterbury, CT (US)

( * ) Notice: Subject to any disclaimer, the term of this patent is extended or adjusted under 35 U.S.C. 154(b) by 579 days.

(21) Appl. No.: 13/961,018

(22) Filed: Aug. 7, 2013

(65) Prior Publication Data

US 2015/0044374 A1 Feb. 12, 2015

(51) Int. Cl.

| | |
|---|---|
| ***C23C 18/18*** | (2006.01) |
| ***C23C 18/16*** | (2006.01) |
| ***C23C 18/20*** | (2006.01) |
| ***C23C 18/36*** | (2006.01) |
| ***C23C 18/34*** | (2006.01) |

(52) U.S. Cl.

CPC ..... *C23C 18/1646* (2013.01); *C23C 18/1637* (2013.01); *C23C 18/1639* (2013.01); *C23C 18/1641* (2013.01); *C23C 18/1824* (2013.01); *C23C 18/1844* (2013.01); *C23C 18/1893* (2013.01); *C23C 18/2046* (2013.01); *C23C 18/2086* (2013.01); *C23C 18/34* (2013.01); *C23C 18/36* (2013.01)

(58) Field of Classification Search

CPC . C23C 18/36; C23C 18/1646; C23C 18/1637; C23C 18/1633; C23C 18/1639; C23C 18/1824

USPC ... 427/97.9, 99.5, 304, 305, 306, 437, 443.1

See application file for complete search history.

(56) References Cited

U.S. PATENT DOCUMENTS

| | | | | |
|---|---|---|---|---|
| 3,644,183 | A | 2/1972 | Odekerken | |
| 4,160,049 | A * | 7/1979 | Narcus | C23C 18/36 427/277 |
| 4,169,171 | A * | 9/1979 | Narcus | C23C 18/1651 427/264 |
| 4,483,711 | A | 11/1984 | Harbulak | |
| 5,258,061 | A | 11/1993 | Martyak et al. | |
| 5,269,838 | A * | 12/1993 | Inoue | C23C 18/34 106/1.22 |
| 6,132,889 | A | 10/2000 | Welty et al. | |
| 6,245,389 | B1 * | 6/2001 | Horikawa | B01D 61/025 427/438 |
| 2003/0232148 | A1 * | 12/2003 | Shahin | C23C 18/36 427/438 |
| 2005/0150774 | A1 | 7/2005 | Dahms et al. | |
| 2006/0147683 | A1 | 7/2006 | Ikeda et al. | |
| 2008/0067679 | A1 * | 3/2008 | Takagi | C23C 18/50 257/751 |
| 2012/0061698 | A1 | 3/2012 | Toscano et al. | |
| 2012/0156387 | A1 * | 6/2012 | Stark | C07C 229/08 427/437 |

FOREIGN PATENT DOCUMENTS

| | | |
|---|---|---|
| CN | 102286735 | 12/2011 |
| DE | 2333096 | 1/1974 |
| DE | 102011003713 | 8/2011 |
| JP | H02170982 | 7/1990 |
| JP | 2002-363771 | 12/2002 |
| JP | 2012224908 | 11/2012 |
| JP | 2013508538 | 3/2013 |

* cited by examiner

*Primary Examiner* — Dah-Wei D. Yuan
*Assistant Examiner* — Nga Leung V Law
(74) *Attorney, Agent, or Firm* — Carmody Torrance Sandak & Hennessey LLP

(57) ABSTRACT

An electroless nickel plating solution and a method of using the same is described. The electroless nickel plating solution comprises (i) a source of nickel ions; (ii) a reducing agent; (iii) one or more complexing agents; (iv) one or more bath stabilizers; (v) a brightener, said brightener comprising a sulfonated compound having sulfonic acid or sulfonate groups; and (vi) optionally, one or more additional additives. The use of the sulfonated compound brightener results in a bright electroless nickel deposit on various substrates having a high gloss value.

17 Claims, No Drawings

ELECTROLESS NICKEL PLATING SOLUTION AND METHOD

FIELD OF THE INVENTION

The present invention relates generally to electroless nickel plating solutions and method of using the same to produce bright deposits.

BACKGROUND OF THE INVENTION

Electroless nickel plating is a process used to deposit one or more layers of nickel onto a substrate without the use of an outside power source. Electroless nickel is also referred to as "autocatalytic" plating because the metal being applied is in solution and adheres itself to the substrate with the use of an electrical power current. Thus, one of the primary benefits of electroless deposition is that it requires no electricity for metallic deposition. Electroless plating also differs from "immersion" plating in that desired thicknesses of the deposited layer(s) can be achieved in contrast to immersion plating in which coverage with only nominal thickness may be achieved.

Electroless nickel processes are capable of depositing a reliable, repeatable nickel coating of uniform thickness on various substrates, including non-conductive or dielectric substrates such as plastics and ceramics and on metal substrates, including steel, aluminum, brass, copper and zinc. Because electroless nickel is free from flux-density and power supply issues, it is capable of providing an even deposit regardless of workpiece geometry. Thus, it is capable of effectively coating substrates with complex geometries, including sharp edges, deep recesses, internal areas, seams and threads, without resulting in excessive build up on points, corners, etc. In addition, electroless nickel coatings also demonstrate excellent corrosion protection and improved wear resistance as well as good lubricity, high hardness and good ductility.

Electroless nickel may be used for the coating of non-conductive substrates such as plastic substrates, to render the surface of such substrates conductive and/or to change the appearance of the substrate. Furthermore, by the deposition of nickel, the material properties of the coated substrate can be improved, including corrosion resistance, hardness and wear resistance.

However, while various electroless nickel plating compositions are known in the art, there remains a need in the art for electroless nickel plating compositions and processes that are capable of producing bright nickel deposits on various substrates.

SUMMARY OF THE INVENTION

It is an object of the present invention to provide an improved electroless nickel plating composition.

It is another object of the present invention to provide an improved electroless nickel plating composition that is capable of producing a bright deposit.

It is still another object of the present invention to provide an electroless nickel plating composition containing an improved brightener.

It is still another object of the present invention to provide a method for the electroless deposition of an electroless nickel layer having improved properties.

It is still another object of the present invention to provide an electroless nickel plating composition that is capable of producing a deposit with a high gloss number.

To that end, in one embodiment, the present invention relates generally to an electroless nickel plating solution comprising:

(1) A source of nickel ions;
(2) A reducing agent;
(3) One or more complexing agents;
(4) One or more bath stabilizers; and
(5) A brightener, said brightener comprising a sulfonated compound selected from the group consisting of alkyl or aryl substituted sulfonamides, alkyl or aryl substituted sulfonic acids, alkyl or aryl substituted sulfosuccinates, and alkyl or aryl substituted sulfonates.

In another embodiment, the present invention relates generally to a process of plating a substrate to provide a bright electroless nickel deposit thereon, the method comprising the steps of:

a) preparing a substrate to accept electroless nickel plating thereon; and
b) plating the prepared substrate with an electroless nickel plating solution, the electroless nickel plating solution comprising:
   1) a source of nickel ions;
   2) a reducing agent;
   3) one or more complexing agents;
   4) one or more bath stabilizers;
   5) a brightener, said brightener comprising a sulfonated compound selected from the group consisting of alkyl or aryl substituted sulfonamides, alkyl or aryl substituted sulfonic acids, alkyl or aryl substituted sulfosuccinates, and alkyl or aryl substituted sulfonates.

wherein a bright electroless nickel layer is deposited on the substrate.

DETAILED DESCRIPTION OF THE PREFERRED EMBODIMENTS

The present invention relates generally to an electroless nickel plating composition and a method of using the electroless nickel plating composition to produce a bright deposit on a substrate.

In one embodiment, the electroless nickel plating solutions of the invention comprise:

(1) A source of nickel ions;
(2) A reducing agent;
(3) One or more complexing agents;
(4) One or more bath stabilizers;
(5) A brightener, said brightener comprising a sulfonated compound selected from the group consisting of sulfonated compound selected from the group consisting of alkyl or aryl substituted sulfonamides, alkyl or aryl substituted sulfonic acids, alkyl or aryl substituted sulfosuccinates, and alkyl or aryl substituted sulfonates.

The source of nickel ions can be any suitable source of soluble nickel ions, and is preferably a nickel salt selected from the group consisting of nickel bromide, nickel fluoroborate, nickel sulfonate, nickel sulfamate, nickel alkyl sulfonate, nickel sulfate, nickel chloride, nickel acetate, nickel hypophosphite and combinations of one or more of the foregoing. In one preferred embodiment, the nickel salt is nickel sulfate or nickel sulfonate. The concentration of the soluble nickel salt in the plating solution is preferably between about 2-10 g/L, more preferably between about 4-9 g/L.

Nickel ions are reduced to nickel metal in the electroless nickel plating bath by the action of chemical reducing agents which are oxidized in the process. The reducing agents to be contained in the plating solution of the present invention include hypophosphites such as sodium hypophosphite; alkali metal borohydrides such as sodium borohydride; soluble borane compounds such as dimethylamine borane and trimethylamine borane; soluble borane compounds usable also as a solvent such as diethylamine borane and isopropylamine borane; and hydrazine. When the hypophosphite is used as the reducing agent, the plating solution of the present invention is an electroless Ni—P plating solution, when the soluble borane compound is used, it is an electroless Ni—B plating solution, and when hydrazine is used as the reducing agent, the plating solution of the present invention is an electroless Ni plating solution. The concentration of the one or more reducing agents in the electroless nickel composition is typically between about 0.01 g/L and about 200 g/L, more preferably between about 20 g/L and about 50 g/L. If the concentration of the one or more reducing agents is less than about 0.01 g/L, the plating speed will be reduced, and if the concentration exceeds about 200 g/L, the effect will be saturated, and the electroless nickel composition may begin to decompose.

The one or more complexing agents comprise ingredients effective to prevent precipitation of the nickel compound and to provide for a moderate rate of the reaction of nickel precipitation. The complexing agent(s) are generally included in the plating solutions in amounts sufficient to complex the nickel ions present in the solution and to further solubilize the hypophosphite (or other reducing agent) degradation products formed during the plating process. The complexing agent(s) generally retard the precipitation of nickel ions from the plating solution as insoluble salts such as phosphites, by forming a more stable nickel complex with the nickel ions. Generally, the complexing agent(s) are used in the compositions at a concentration of up to about 200 g/L, preferably about 15 to about 75 g/L, and most preferably about 20 to about 40 g/L.

Useful nickel complexing (or chelating) agents include, for example, carboxylic acids, polyamines or sulfonic acids, or mixtures thereof, by way of example and not limitation. Useful carboxylic acids include the mono-, di-, tri-, and tetra-carboxylic acids which may be substituted with various substituent moieties such as hydroxy or amino groups. The acids may be introduced into the plating solutions as their sodium, potassium or ammonium, salts. Some complexing agents such as acetic acid, for example, may also act as a buffering agent, and the appropriate concentration of such additive components can be optimized for any plating solution after consideration of their dual functionality.

Examples of carboxylic acids which are useful as the nickel complexing agent the solutions of the present invention include: monocarboxylic acids such as acetic acid, glycolic acid, glycine, alanine, lactic acid; dicarboxylic acids such as succinic acid, aspartic acid, malic acid, malonic acid, tartaric acid; tricarboxylic acids such as citric acid; and tetracarboxylic acids such as ethylene diamine tetra acetic acid (EDTA), which may be used alone or in combination with each other. In one preferred embodiment, the complexing agents comprise a mixture of one or more monocarboxylic acids and one or more dicarboxylic acids.

The electroless plating deposition rate is further controlled by selecting the proper temperature, pH and metal ion/reducer concentrations. Complexing ions may also be used as catalyst inhibitors to reduce the potential for spontaneous decomposition of the electroless nickel plating bath.

The one or more bath stabilizers are added to provide a sufficient bath lifetime and reasonable deposition rate and to control the content of any alloying materials. For example, the stabilizing agent may be used to control the phosphorus content in the as deposited nickel phosphorus alloy. Stabilizing agents include organic and/or inorganic stabilizing agents such as lead ions, cadmium ions, tin ions, bismuth ions, antimony ions and zinc ions, which can be introduced in the form of bath soluble and compatible salts such as the acetates. Suitable bismuth compounds include, for example, bismuth oxide, bismuth sulfate, bismuth sulfite, bismuth nitrate, bismuth chloride, bismuth acetate and the like. Organic stabilizers include sulfur containing compounds such as, for example, thiourea, mercaptans, sulfonates, thiocyanates, etc. The stabilizers are typically used in small amounts such as from 0.1 to about 5 mg/L solution, and more often in amounts of from about 0.5 to 2 or 3 mg/L of solution. The upper limit of the concentration of the metal stabilizers is such that the deposition velocity is not reduced.

A variety of additives may also be included in the electroless nickel plating solution, including, for example, buffers, wetting agents, accelerators, corrosion inhibitors, etc. as is generally well known in the art.

The aqueous electroless nickel plating baths described herein can be operated over a broad pH range such as from about 4 to about 10. For an acidic bath, the pH can generally range from about 4 to about 7, more preferably from about 4 to about 6. For an alkaline bath, the pH can range from about 7 to about 10, more preferably from about 8 to about 9. Since the plating solution has a tendency to become more acidic during its operation due to the formation of hydrogen ions, the pH may be periodically or continuously adjusted by adding bath-soluble and bath-compatible alkaline substances such as sodium, potassium or ammonium hydroxides, carbonates and bicarbonates.

The stability of the operating pH of the plating solutions of the present invention can be improved by the addition of various buffer compounds such as acetic acid, propionic acid, boric acid, or the like, in amounts up to about 30 g/L with amounts of from about 2 to about 10 g/L being typical. As noted above, some of the buffering compounds such as acetic acid and propionoic acid may also function as complexing agents.

As discussed above, the inventors of the present invention have surprisingly discovered that the brightness of the nickel deposit can be greatly improved by the inclusion of a suitable brightener into the plating bath of the invention. In particular, the inventors of the present invention have found that suitable brighteners for use in the present invention include sulfonated compounds selected from the group consisting of alkyl or aryl substituted sulfonamides, alkyl or aryl substituted sulfonic acids, alkyl or aryl substituted sulfosuccinates, and alkyl or aryl substituted sulfonates, including for example, 2-amino ethane sulfonic acid, toluene sulfonamide, 1-octane sulfonic acid, 2-chloro-2-hydroxypropane sulfonic acid, saccharin, sodium diamyl sulfosuccinate, sodium 1,4 bis (1,3-dimethylbutyl) sulfosuccinate, sulfosuccinic acid, and sodium allyl sulfonate. In one preferred embodiment, the sulfonated compound is 2-amino ethane sulfonic acid. In another preferred embodiment, the sulfonated compound is at least substantially the only brightener in the electroless nickel plating solution. The concentration of the sulfonated compound in the electroless nickel plating solution is preferably in the range of about 0.1-3.0 mg/L, more preferably about 0.5-2.0 mg/L.

In another preferred embodiment, the present invention relates generally to a process of plating a substrate to provide a bright electroless nickel deposit thereon, the method comprising the steps of:

a) preparing a substrate to accept electroless nickel plating thereon; and b) plating the prepared substrate with an electroless nickel plating solution, the electroless nickel plating solution comprising:

1) a source of nickel ions;

2) a reducing agent;

3) one or more complexing agents;

4) one or more bath stabilizers;

5) a brightener, said brightener comprising sulfonated compound selected from the group consisting of sulfonated compound selected from the group consisting of alkyl or aryl substituted sulfonamides, alkyl or aryl substituted sulfonic acids, alkyl or aryl substituted sulfosuccinates, and alkyl or aryl substituted sulfonates; and wherein a bright electroless nickel layer is deposited on the substrate.

Preferably, prior to contacting the metal surface with the electroless plating composition, the metal surface is cleaned. For example, cleaning may be accomplished using an acidic cleaning composition or other such cleaning composition as is generally well known in the art.

In addition, in order to successfully plate nickel on certain metal surfaces, it may be necessary to activate the surfaces with a precious metal activator prior to contacting the surfaces with the electroless nickel plating bath. The precious metal activator typically comprises colloidal or ionic palladium, gold or silver and, if necessary, is performed before the electroless step.

Optionally, the surface may also be microetched to increase the magnitude and reliability of the subsequent bond, depending on the substrate being plated. The time and temperature of the contact with the microetchant may vary depending, for example, upon the type of microetchant being used and the characteristics of the surface with the goal being the attainment of a uniformly rough metal surface.

The electroless nickel plating bath is generally kept at a temperature of between about 160 and about 220° F., more preferably at a temperature of between about 190 and about 210° F. and the metal substrate is contacted with the electroless nickel plating bath while the plating bath is maintained at this temperature.

Plating is continued until a desired plating thickness on the substrate is obtained. For example, as set forth above, the total thickness of the electroless nickel plated on the substrate is typically in the range of about 1 to about 500 microinches, more preferably in the range of about 100 to about 250 microinches. In addition, plating time will depend on various factors including, but not limited to, the plating bath chemistry, the temperature of the plating bath and the pH of the plating bath, but is typically in the range of about 0.1 to about 60 minutes, more preferably about 1 to about 30 minutes.

In addition, it is contemplated that various substrates may be plated using the electroless nickel plating solution described herein including metal substrates, for example, steel, aluminum, copper, brass, etc., and non-conductive substrates such as plastics and ceramics. In one preferred embodiment, the substrate is steel.

EXAMPLE

An electroless nickel plating solution was prepared as set forth in Table 1.

TABLE 1

| Ingredient | Concentration |
|---|---|
| Nickel metal | 6 g/L |
| Malic acid | 16 g/L |
| Lactic acid | 10.5 g/L |
| Glycine | 5 g/L |
| Acetic acid | 17 g/L |
| Sodium hypophosphite | 30 g/L |
| 2-aminothiazole | 2.0 mg/L |
| Bismuth | 2.5 mg/L |
| Sulfonated compound (Table 2) | 0.8 mg/L |

Unpolished ACT steel test panels (available from ACT Test Panel Technologies, Hillsdale, Mich.) were plated to 1.0 mil thickness using the composition described in Table 1.

The test panels were prepared by subjecting the panels to the following process steps:

(1) Soak clean—10% b/v ISOPREP 172 at 160° F., 1 minute;

(2) Electroclean—10% b/v ISOPREP 172 at 160° F. for 1 minute, 2-4 volts;

(3) Acid activation—50% HCl at ambient temperature for 1 minute; and (4) Electroless nickel plating.

Clean water rinses were also performed in between each of the above processing steps.

The plating time is dependent upon the desired thickness. A plating rate of about 0.9 mil/hr was achieved at a temperature of 193° F. and pH of 4.9.

The Gloss Units (GU) value of the deposited nickel layer is measured by a Statistical Glossmeter (available from Elcometer, Inc., Rochester Hills, Mich.).

Gloss is measured by directing a constant intensity light beam at an angle to the test surface and monitoring the reflected light at the same angle. Different gloss levels require different angles. The gloss meter measures the amount of light reflected back at either a 20 degree or a 60 degree angle. The gloss meter can be used in accordance with national and international standards, AS 1580-602.2, ASTM C 584, ASTM D 523, ASTM D 1455, and BS DIN EN ISO 2813. In this instance, we focused on ASTM D 523 standard –1 m mil thick with a steel panel at 20 degree angle. The higher the gloss number, the brighter the deposit. Table 2 shows the results of using an electroless nickel bath of Table 1 with the specific sulfonated compound of Table 2.

TABLE 2

| Compound | Concentration | GU Value |
|---|---|---|
| 2-amino ethane sulfonic acid | 0.8 mg/L | 227 |
| Toluene sulfonamide | 0.8 mg/L | 171 |
| 1-octane sulfonic acid | 0.8 mg/L | 194 |
| 1-chloro-2-hydroxy propane sulfonic acid | 0.8 mg/L | 217 |
| Saccharin | 0.8 mg/L | 188 |

Surprisingly, the use of any of these brighteners in the electroless nickel plating compositions described herein brightened the nickel deposit above about 120 GU, more preferably above about 170 GU and most preferably above about 200 GU. Thus, it can be seen that the use of these sulfonated compound in electroless nickel plating compositions results in an electroless nickel deposit that is much brighter than the electroless nickel deposits achieved by prior art compositions that do not include such brighteners.

What is claimed is:

1. A process of plating a substrate to provide a bright electroless nickel deposit thereon, the method comprising the steps of:

a) preparing a substrate to accept electroless nickel plating thereon; and b) plating the substrate with an electroless nickel plating solution, the electroless nickel plating solution comprising;

1) a source of nickel ions;

2) a reducing agent;

3) one or more complexing agents;

4) one or more bath stabilizers, said one or more bath stabilizers comprising a source of bismuth ions; and 5) a brightener selected from the group consisting of alkyl or aryl substituted sulfonamides, alkyl or aryl substituted sulfonic acids, alkyl or aryl substituted sulfosuccinates, and alkyl or aryl substituted sulfonates;

wherein the concentration of the brightener in the electroless nickel plating solution is in the range of about 0.1-3.0 mg/l; and wherein the deposited electroless nickel layer has a measured gloss unit value above about 120.

2. The process according to claim 1, wherein the brightener is selected from the group consisting of 2-amino ethane sulfonic acid, toluene sulfonamide, 1-octane sulfonic acid, 2-chloro-hydroxy-propane sulfonic acid, saccharin, sodium diamyl sulfosuccinate, sodium 1,4,-bis(1,3-dimethylbutyl) sulfosuccinate, sulfosuccinic acid, and sodium allyl sulfonate.

3. The process according to claim 2, wherein the brightener is 2-amino ethane sulfonic acid.

4. The process according to claim 1, wherein the brightener is substantially the only brightener in the electroless nickel plating solution.

5. The process according to claim 1, wherein the deposited electroless nickel layer has a measured gloss unit value above about 170.

6. The process according to claim 5, wherein the deposited electroless nickel layer has a measured gloss unit value above about 200.

7. The process according to claim 1, wherein the substrate is a metal substrate selected from the group consisting of steel, aluminum, copper, zinc and brass.

8. The process according to claim 7, wherein the substrate is steel.

9. The process according to claim 1, wherein the substrate is a non-conductive substrate selected from the group consisting of plastics and ceramics.

10. The process according to claim 1, wherein the one or more complexing agents are selected from the group consisting of carboxylic acids, polyamines or sulfonic acids, or mixtures thereof.

11. The process according to claim 10, wherein the concentration of the one or more complexing agents is about 15 to about 75 g/L.

12. The process according to claim 11, wherein the concentration of the one or more complexing agents is about 20 to about 40 g/L.

13. The process according to claim 1, wherein the step of preparing a substrate to accept electroless nickel plating thereon involves one or more of the following:

1) cleaning the substrate;

2) activating the substrate; or 3) microetching the substrate.

14. The process according to claim 1, wherein the concentration of the brightener in the electroless nickel plating solution is in the range of about 0.5-2.0 mg/L.

15. The process according to claim 14, wherein the concentration of the brightener in the electroless nickel plating solution is about 0.8 mg/L.

16. The process according to claim 1, wherein the electroless nickel plating solution further comprises 2-aminothiazole.

17. A process of plating a substrate to provide a bright electroless nickel deposit thereon, the method comprising the steps of:

a) preparing a substrate to accept electroless nickel plating thereon; and b) plating the substrate with an electroless nickel plating solution, the electroless nickel plating solution comprising;

1) a source of nickel ions;

2) a reducing agent;

3) one or more complexing agents, the one or more complexing agents in a concentration of about 15 to about 75 g/L;

4) one or more bath stabilizers, the one or more bath stabilizers comprising a source of bismuth ions;

5) a brightener selected from the group consisting of alkyl or aryl substituted sulfonamides, alkyl or aryl substituted sulfonic acids, alkyl or aryl substituted sulfosuccinates, and alkyl or aryl substituted sulfonates, the sulfonated compound in a concentration of about 0.1-3.0 mg/L; and 6) 2-aminothiazole;

wherein the deposited electroless nickel layer has a measured gloss unit value above about 170.

* * * * *